US012606410B2

(12) United States Patent
Henry et al.

(10) Patent No.: US 12,606,410 B2
(45) **Date of Patent: *Apr. 21, 2026**

(54) LOW TENSION APPLICATION COILER

(71) Applicant: Reel Power Licensing Corp., Oklahoma City, OK (US)

(72) Inventors: Joe Henry, Oklahoma City, OK (US); Lance Collier, Oklahoma City, OK (US); Carl Parker, Oklahoma City, OK (US)

(73) Assignee: Reel Power Licensing Corp., Oklahoma City, OK (US)

( * ) Notice: Subject to any disclaimer, the term of this patent is extended or adjusted under 35 U.S.C. 154(b) by 73 days.

This patent is subject to a terminal disclaimer.

(21) Appl. No.: 18/472,921

(22) Filed: Sep. 22, 2023

(65) Prior Publication Data

US 2024/0010460 A1 Jan. 11, 2024

Related U.S. Application Data

(63) Continuation of application No. 17/571,728, filed on Jan. 10, 2022, now Pat. No. 11,795,030, which is a continuation of application No. 16/844,503, filed on Apr. 9, 2020, now Pat. No. 11,247,868, which is a continuation of application No. 16/224,005, filed on Dec. 18, 2018, now Pat. No. 10,647,540.

(60) Provisional application No. 62/608,698, filed on Dec. 21, 2017.

(51) Int. Cl.

| | |
|---|---|
| ***B65H 59/38*** | (2006.01) |
| ***B65H 51/10*** | (2006.01) |
| ***B65H 54/28*** | (2006.01) |
| ***B65H 59/00*** | (2006.01) |

(52) U.S. Cl.

CPC ..... *B65H 59/385* (2013.01); *B65H 51/10* (2013.01); *B65H 54/2833* (2013.01); *B65H 59/005* (2013.01); *B65H 2701/33* (2013.01)

(58) Field of Classification Search

CPC .. B65H 59/005; B65H 59/385; B65H 59/388; B65H 51/10; B65H 54/2833; B65H 54/2884; B65H 2701/33

See application file for complete search history.

(56) References Cited

U.S. PATENT DOCUMENTS

| | | | | |
|---|---|---|---|---|
| 4,664,329 | A * | 5/1987 | Pali | B65H 59/00 242/615.1 |
| 10,647,540 | B2 | 5/2020 | Henry | |
| 11,247,868 | B2 | 2/2022 | Henry | |
| 11,795,030 | B2 * | 10/2023 | Henry | B65H 59/005 |
| 2009/0289141 | A1 | 11/2009 | Griesshammer et al. | |
| 2016/0083217 | A1 | 3/2016 | Kotzur et al. | |
| 2016/0311640 | A1 | 10/2016 | Moore | |
| 2017/0101287 | A1 | 4/2017 | Griesshammer | |
| 2017/0233215 | A1 | 8/2017 | Lasswell et al. | |

* cited by examiner

*Primary Examiner* — William A. Rivera
(74) *Attorney, Agent, or Firm* — Phillips Murrah PC; Martin G. Ozinga

(57) ABSTRACT

An apparatus, system, and method for a low tension application spooler and or coiler system that positively drives the material into the coil and or reel so that the tension is minimum during the winding process.

1 Claim, 7 Drawing Sheets

LOW TENSION APPLICATION COILER

CROSS-REFERENCE TO RELATED APPLICATIONS

This application is a continuation of U.S. patent application Ser. No. 17/571,728, filed on Jan. 10, 2022, currently pending, which is a continuation of U.S. patent application Ser. No. 16/844,503, filed on Apr. 9, 2020, now U.S. Pat. No. 11,247,868, issued on Feb. 15, 2022, which is a continuation of U.S. patent application Ser. No. 16/224,005, filed on Dec. 18, 2018, now U.S. Pat. No. 10,647,540, issued on May 12, 2020, in which priority is claimed from U.S. Provisional Application Ser. No. 62/608,698 filed on Dec. 21, 2017. Each of the applications listed above is hereby expressly incorporated herein by reference in their entirety.

BACKGROUND OF INVENTION

1. Field of the Invention

In general, the present invention relates to an apparatus and or system used to coil lengths where a very low tension is required for winding plastic profiles, such as hollow profiles or flexible extrusions that are easily damaged and or take a set on the reel of hoses, cable, tubing, wiring, and the like. More particularly, the present invention provides an improved coiling by positively driving the material into the coil or reel so that the tension is absolute minimum during the winding process.

2. Description of the Prior Art

In general, lengths of material that are usually relatively long and flexible are wound on large reels and or spools by a manufacturer. It is known for redistribution to take these large reels and or spools of materials into smaller amounts for redistribution. The machines associated with such are often referred to as automatic cut and transfer coiling and or spooling machines. Coiling is typically a reference to taking the elongated material from a large spool and or reel to a smaller desired length for redistribution and wrapping it freely into a coil with no spool and or reel. Spooling is typically a reference to taking the elongated material from a large spool and or reel to a smaller desired length for redistribution then wrapped around another spool and or reel for redistribution.

There is known difficulty in winding more delicate plastic profiles, such as hollow profiles or flexible extrusions. These may be easily damaged or take a set on the reel due to the delicate nature and forces applied to the material during the winding process. It is known that too much tension in the winding process can undesirably stretch or curl the material. In the prior art, typically the winder, or spindle of the winder itself does the pulling of the elongated materials and is known to sometimes cause too much friction and tension build up on the material during the winding process.

It is also desirable to have precise winding when dealing with more delicate elongated materials. Overlapping, excessive gaps between rows, inconsistent product orientation, "roll overs", tangled rows, are known problems and undesirable. When winding elongated materials with a pile, it is also undesirable to crush the pile or distort the pile.

By example, but not to be considered limiting, medical tubing is often relatively small and flexible for use in medical, surgical, catheter, hypodermic applications, and so forth. This tubing is typically made by extrusion in large quantities wrapped around spools and or reels. The manufactured tube may be very long and a desired length for redistribution of the tubing may be just a few feet. Considering that medical tubing quality and precision may be a matter of life and death, it is highly undesirable to have tubing that gets kinked or otherwise damaged in the spooling and or coiling process.

Thus, there is a need for a new and improved coiling method which has low tension and precise winding such that the elongated material being wound is not damaged in the process. It is desirable to fill these needs with a reliable alternative that is affordable and functional. The above discussed limitations in the prior art is not exhaustive. The current invention provides an inexpensive, time saving, more reliable apparatus, method, and system where the prior art fails.

SUMMARY OF THE INVENTION

In view of the foregoing disadvantages inherent in the known types of spooling and coiling systems now present in the prior art, the present invention provides a new and improved apparatus, system, and method of using the same. As such, the general purpose of the present invention, which will be described subsequently in greater detail, is to provide a new and improved spooling and or coiling system for use with elongated materials, which has all the advantages of the prior art devices and none and or fewer of the disadvantages.

It is, therefore, contemplated that the present invention is an apparatus, system, and method for a new and improved spooling and or coiling system that positively drives the material into the coil and or reel so that the tension is absolute minimum during the winding process. It is contemplated to first provide a powered feed roller and or rollers that first pulls the elongated material from the source and then feeds the elongated material onto the coil and or reel. The spindle that drives the coil and or reel is a slave to the first powered roller. The spindle is computer controlled to synchronize and match effective surface speed with the feed roller wherein tension can be controlled at a minimum during the winding process. It is also contemplated that the feed roller may be servo driven with an articulating lay-on guide arm for precise positioning during the winding process.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved spooling and or coiling apparatus, system, and method for use with elongated materials where it is desirable to prevent and or reduce damage associated with the winding process.

Furthermore, an object of the present invention is to provide a new and improved spooling and or coiling apparatus, system and method, which provides a low tension winding that reduces damages to more delicate elongated materials that are easily damaged.

Another object of the present invention is to provide a new and improved spooling and or coiling apparatus, system, and method, which may provide neatly wound rows of product without overlapping, excessive gaps between rows, consistent product orientation with no "roll-overs", and no tangled rows.

Still another object of the present invention is to provide a new and improved spooling and or coiling apparatus, system, and method, which does not crush or distort elongated materials with a pile.

It is a further object of the present invention to provide a new and improved spooling and or coiling apparatus, system, and method, which is of a durable and reliable construction and may be utilized in numerous types of coiling applications.

An even further object of the present invention is to provide a new and improved spooling and or coiling apparatus, system, and method, which benefits from a low cost of manufacture, which accordingly results in a low price of sale to the consuming industry, thereby making such a system economically available to those in the industry.

Still another object of the present invention is to provide a new and improved spooling and or coiling apparatus, system, and method, which provides all the advantages of the prior art while simultaneously overcoming some of the disadvantages normally associated therewith.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such a description makes reference to the annexed pictorial illustrations, graphs, drawings, and appendices.

DETAILED DESCRIPTION OF INVENTION

Figure 1:
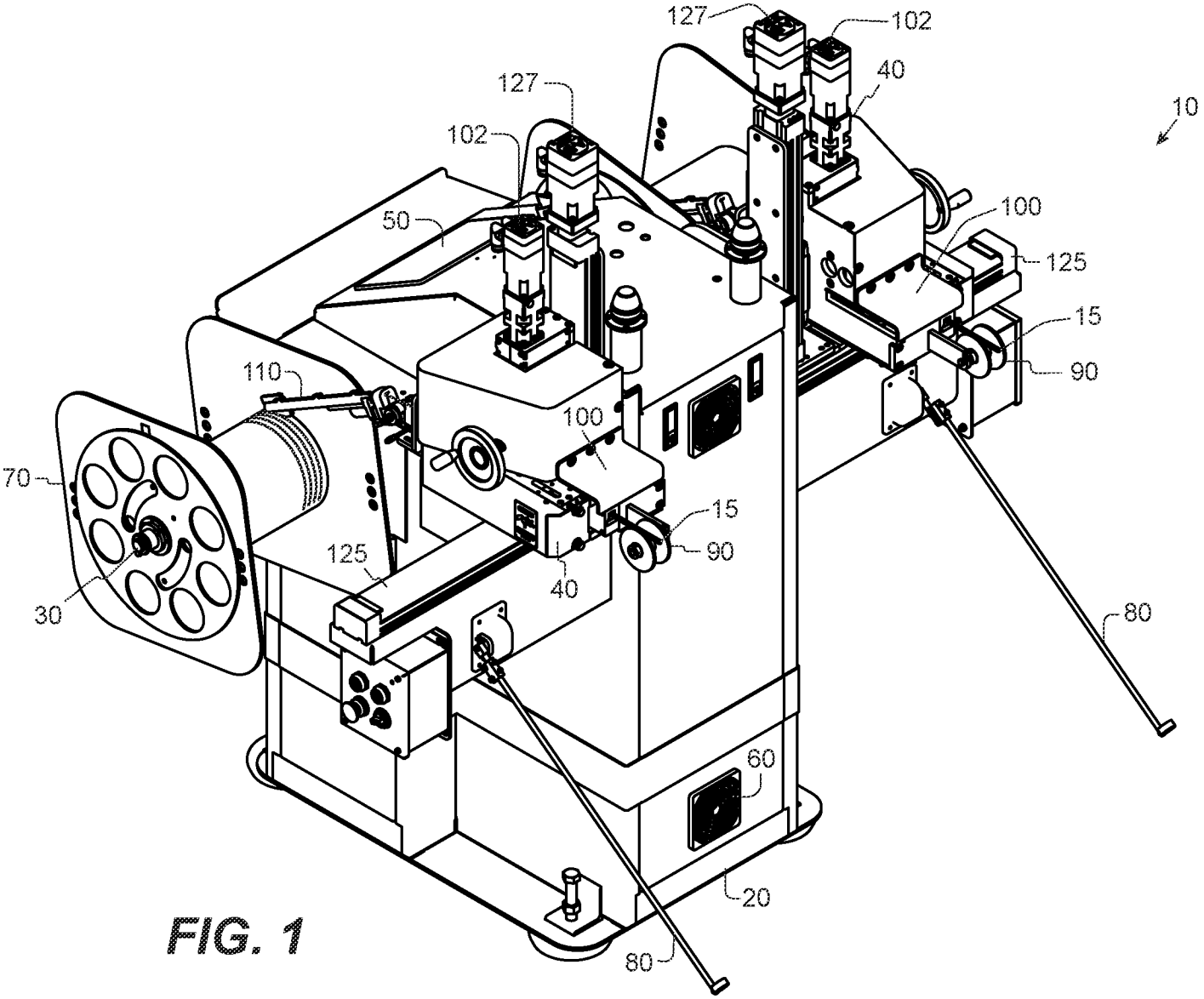
FIG. 1 is a general front perspective view of a preferred embodiment in accordance with the current invention.
Figure 2:
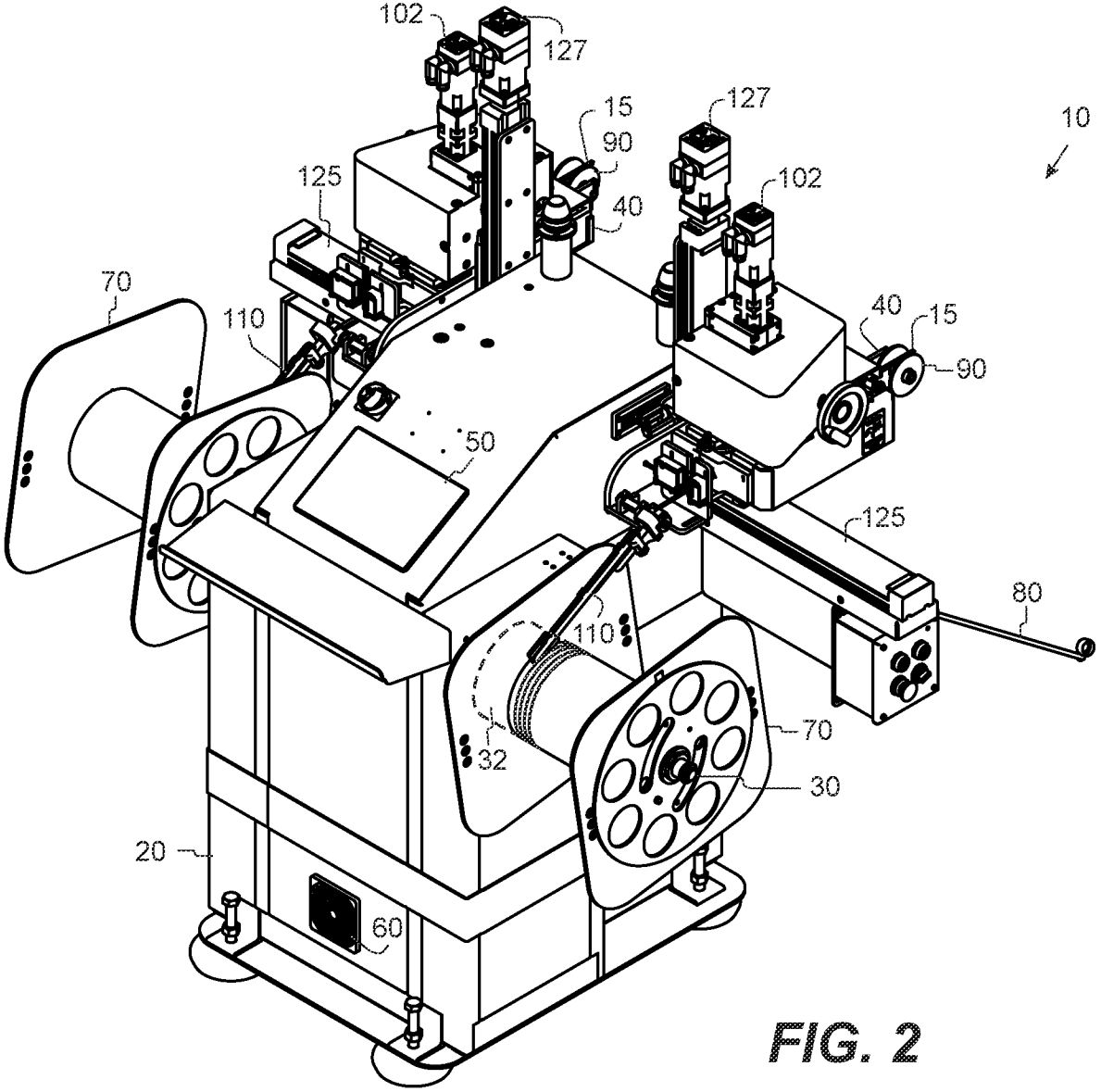
FIG. 2 is a general back perspective view of a preferred embodiment in accordance with the current invention.

Referring to the illustrations, drawings, and pictures, and to FIGS. 1 and 2 in particular, reference character 10 generally designates a new and improved spooling and or coiling apparatus, system, and method of using the same constructed in accordance with the present invention. It is understood that the terms "spool", "reel", and "coil" are references to wrapping an elongated material into circular form for handling and distribution. Invention 10 is generally used with elongated materials 15 needing to be made into smaller segments for distribution from a larger spool and or reel. Elongated materials 15 may be but is not limited to plastic profiles, such as but not limited to hollow profiles, flexible extrusions, hoses electrical cables, steel cables, wire cables, felt, and so forth. For purposes of convenience, the reference numeral 10 may generally be utilized for the indication of the invention, portion of the invention, preferred embodiments of the invention and so on. It is also to be understood that invention 10 should not be considered limited to just a spooling and coiling and the terms should not be considered to limit the invention to such.

Invention 10 may comprise a frame 20, a motorized spindle and or spindle 30, a feed system 40, a computer and or computer control 50, and a power source 60. It is understood that spindle 30 may be utilized with a spool and or reel 70 although it is understood that spindle 30 may be utilized without reel 70 when coiling elongated materials. Spindle 30 may be powered by servo and or motor 32 that may be in communication with computer 50 for controlling rotation of spindle 30.

It is also understood that frame 20 may have dual winding stations as generally depicted although it is contemplated to have just one winding station, two, three and so forth. The current invention should not be limited to the illustrations depicting two.

Feed system 40 may include a mechanical dancer 80, an intake wheel 90, a motorized roller system and or roller system 100, and articulating lay-on guide arm 110, which may be on motorized traverse and or traverse 125. Roller system 100 may have a motor and or servo 102 that may be in communication with computer 50 for controlling the speed of rotation of same. Articulating lay-on guide arm 110 may be a servo driven. Mechanical dancer 80 may not be positioned on traverse 125 but on frame 20.

Motorized traverse system and or traverse 125 may have a motor and or servo 126 and or more than one motor and or motor and or servo 127. It is contemplated that servo 126 and or servo 127 may be in communication with computer control 50 for controlling the speed of rotation of same.

Figure 3:
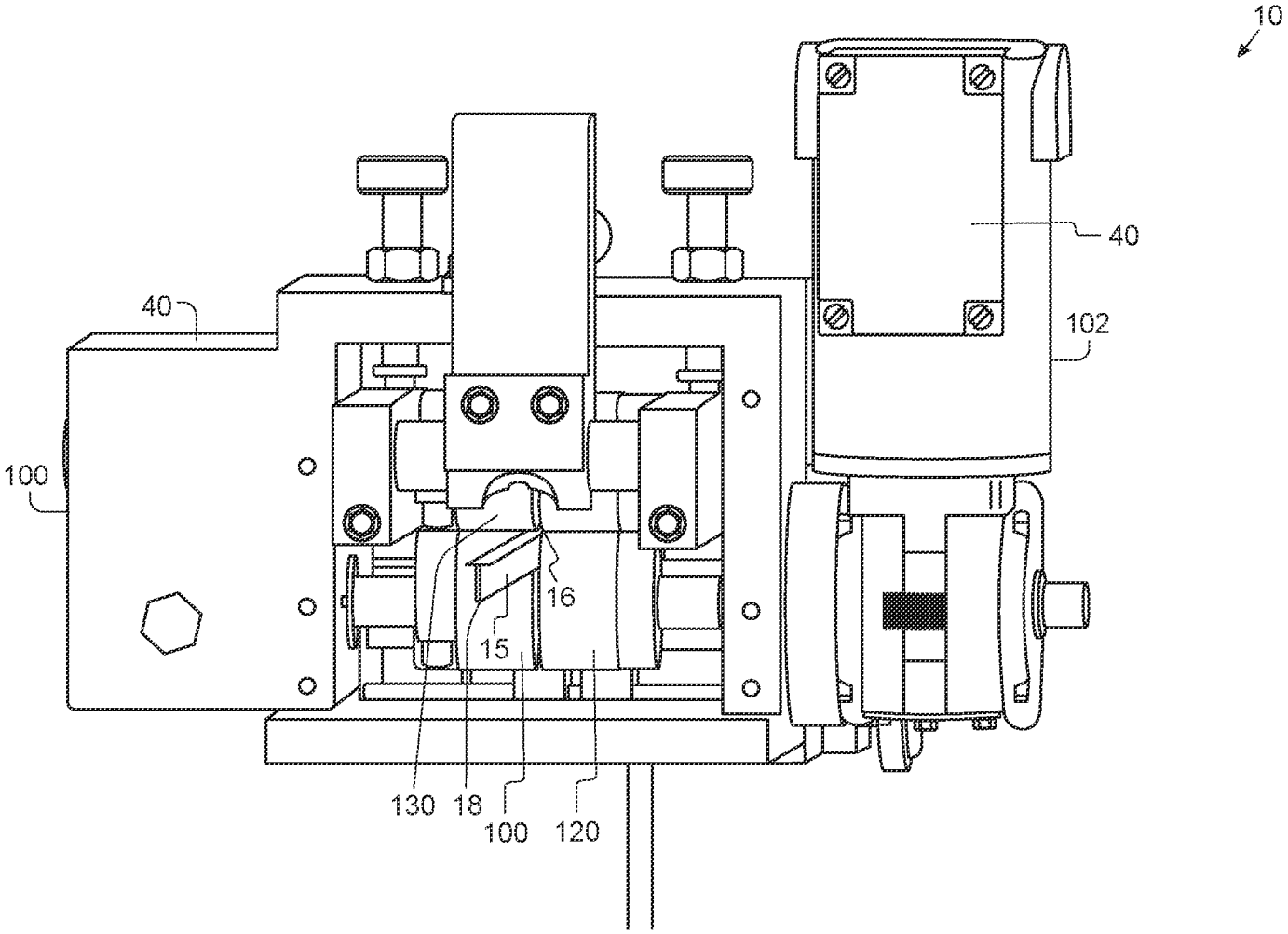
FIG. 3 is a general partially cutaway perspective view of a preferred embodiment in accordance with the current invention of the feed and roller system with generally horizontal rollers.
Figure 4:
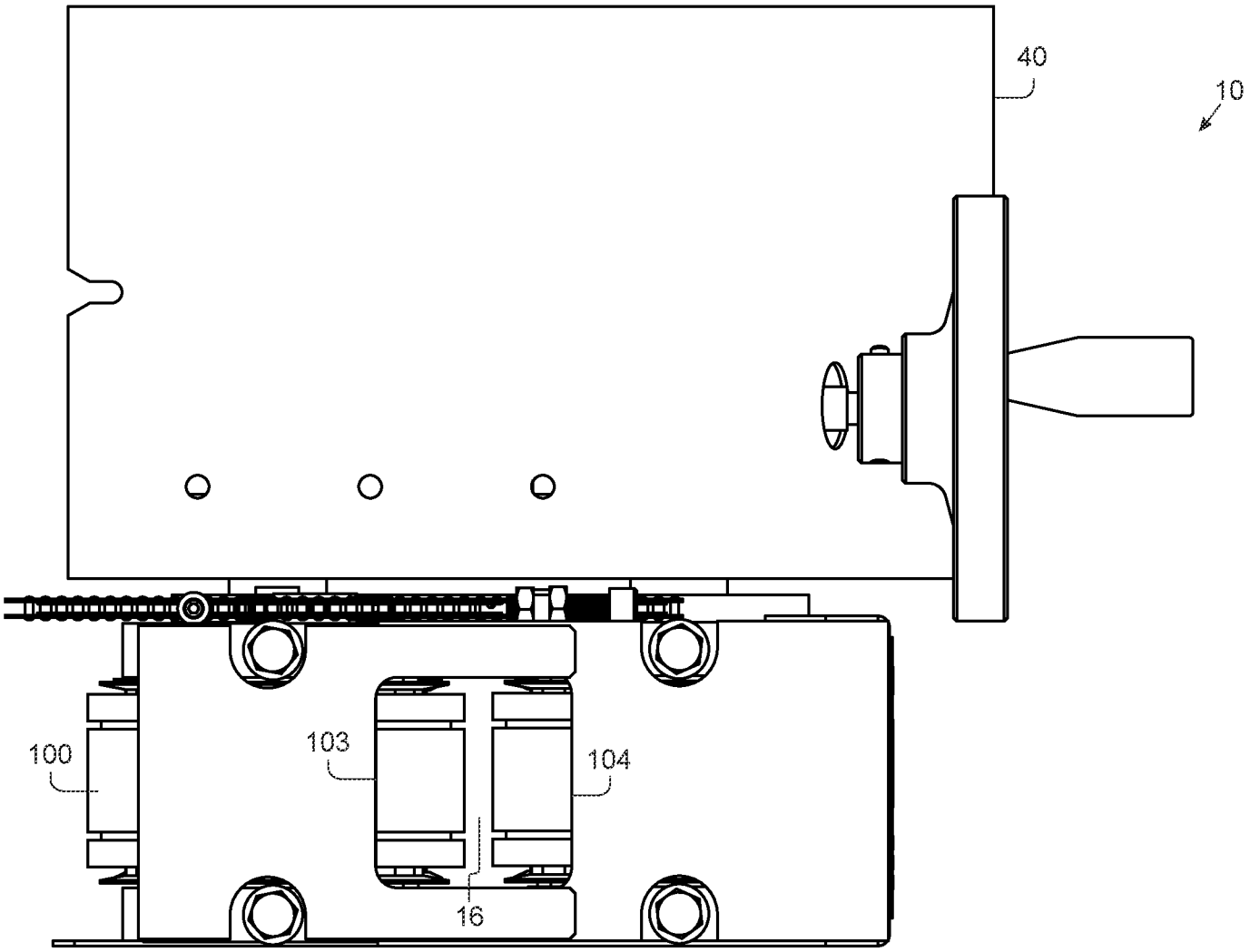
FIG. 4 is a general partially exploded front view of a preferred embodiment in accordance with the current invention of a feed and roller system with generally vertical rollers.
Figure 5:
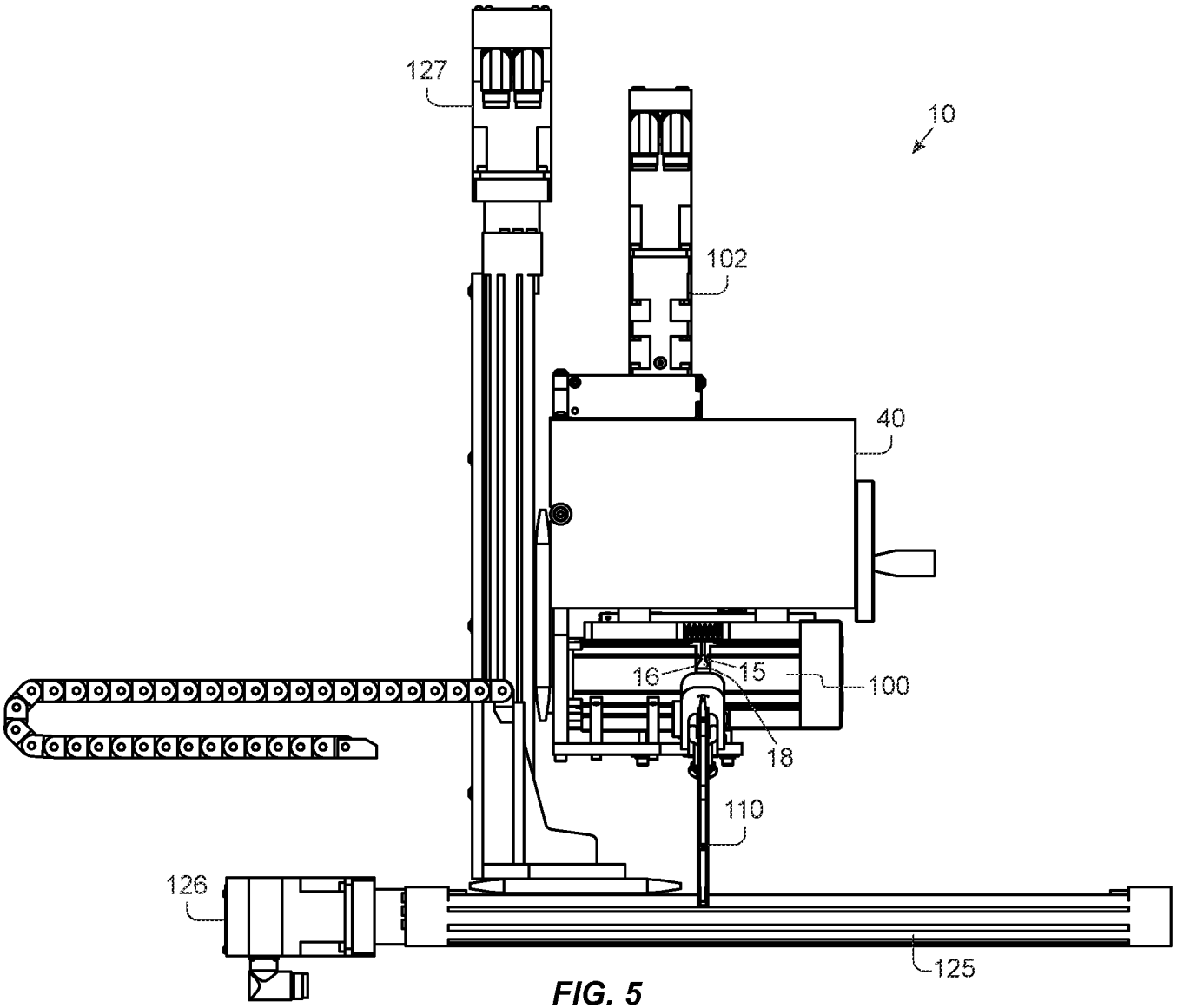
FIG. 5 is a general back partial view of a preferred embodiment in accordance with the current invention with vertical rollers.
Figure 6:
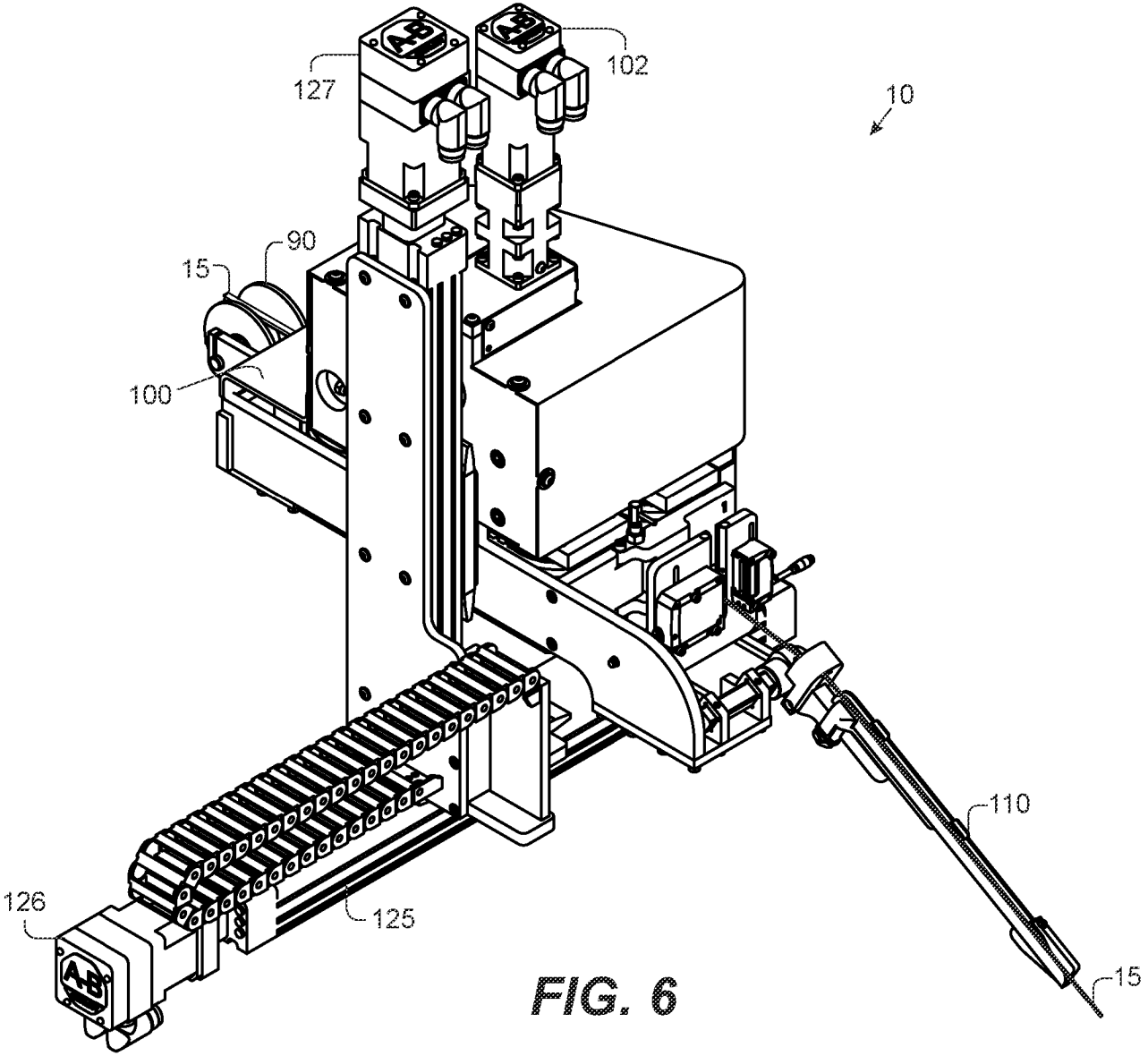
FIG. 6 is a general partial back perspective view of a preferred embodiment in accordance with the current invention.
Figure 7:
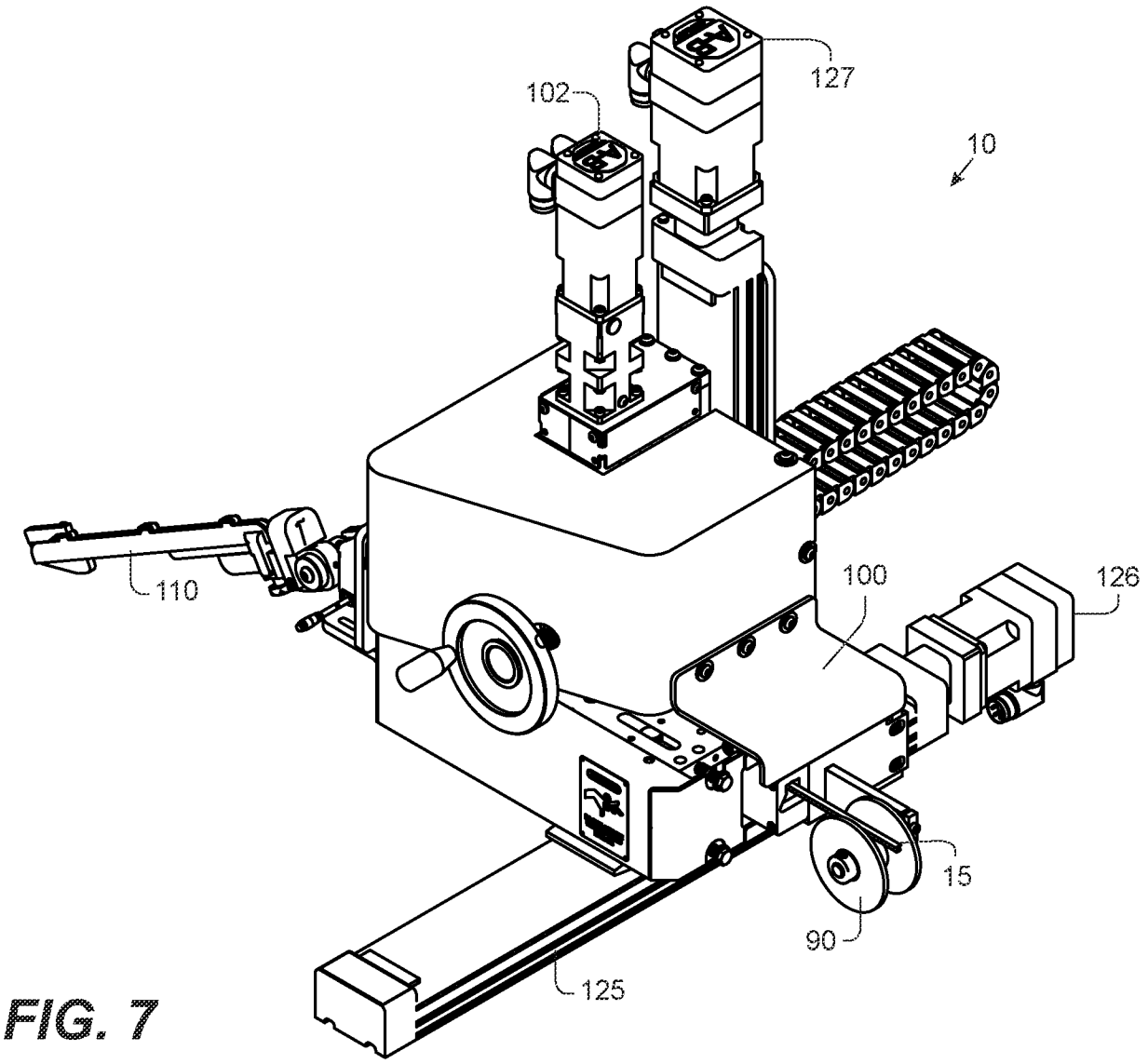
FIG. 7 is a general partial front perspective view of a preferred embodiment in accordance with the current invention.

Now again generally referring to the illustrations and more particular to FIG. 3, it is contemplated that roller system 100 may have a bottom roller 120 and a top roller 130 with top roller 130 under spring tension pushes down on the elongated material 15 as its being fed through the feed system 40 and pushing it into the reel 70. The rollers system 100 may have a profile 16 cut into the respective bottom roller 120 and top roller 130 to match a shape 18 of the elongated materials 15 passing through. This may prevent any damage and or distortion to the elongated material 15. Rollers system 100 may be servo 102 driven, but not limited to same. It is also understood that feed system 40 may not utilize roller system 100, but may use belts or pull/push rolls, combinations thereof and so forth.

Referring to the illustrations and more in particular to FIGS. 4 through 7, invention 10 contemplates roller system 100 utilizing a first side roller 103 and a second side roller 104 with a general vertical orientation. It is also understood that first side roller 103 and a second side roller 104 be generally vertical belts or pull/push rolls, combinations thereof and so forth.

In the prior art, spindle 30 is independently powered and does the pulling. This is known to cause undesired amounts of friction and undesired tension on the elongated material 15 during the winding process. The current invention 10 contemplates positively driving the elongated material 15 into the reel 70, and or coil mounted on spindle 30, wherein the tension is minimum during the winding process.

This is generally accomplished by during the elongated material 15 with the feed system 40 and having the spindle 30 synchronized to accept the elongated material 15 without pulling during the winding process. Spindle 30 is still powered but the computer control 50 monitors the feed system 40 speed and adjusts spindle 30 speed accordingly. Spindle 30 will become a slave axis to the feed system 40, matching its effective surface speed to the roller system 100 linear speed thus allowing a 'tweak' factor to allow good winding if needed with computer control 50. The master axis will be the feed system 40 and may change speeds in response to the mechanical dancer 80 feedback and the line speed feed forward to match the line speed.

It is contemplated to wind and keep track of pitch and diameter and layers all without a diameter sensor. This may be possible due to the complete data entered in the recipe for elongated material 15 width, height, width of reel 70, reel 70, and so forth. It is understood that a diameter sensor may be utilized and or in combination thereof.

Invention may mount feed system 40 on traverse 125 with servo 127 and or and be a slave to the spindle 30 axis to maintain the recipe driven pitch and end points based on reel 70 dimensions. The articulating lay-on guide arm 110 axis may be a slave to the traverse 125 axis, pointing along the tangent to the effective winding surface, and generally raising as the material layers up while winding.

It is therefore contemplated to provide a low tension application spooler for spooling or coiling elongated materials comprising: a frame; a motorized spindle attached to said frame and having a spool adapted to receive said elongated material for wrapping; a motorized traverse system adapted to move horizontally on said frame for wrapping said elongated material on said spool; a motorized roller system attached to said traverse adapted to push said elongated material to said spool for wrapping around said spool and wherein said motorized spindle is slaved to said motorized roller system; and a computer attached to said frame and in communication with said motorized spindle for controlling said motorized spindle, with said motorized traverse for controlling said motorized traverse, and with said motorized roller system for controlling said motorized roller system.

Changes may be made in the combinations, operations, and arrangements of the various parts and elements described herein without departing from the spirit and scope of the invention. Furthermore, names, titles, headings, and general division of the aforementioned are provided for convenience and therefore, should not be considered limiting.

What is claimed is:

1. A low tension application spooler for spooling or coiling elongated materials comprising:

a frame;

a motorized spindle attached to said frame and having a spool adapted to receive said elongated material for wrapping wherein said elongated material are wire cables;

a motorized traverse system adapted to move horizontally on said frame for wrapping said elongated material on said spool;

a motorized roller system attached to said traverse adapted to push said elongated material to said spool for wrapping around said spool and wherein said motorized spindle is slaved to said motorized roller system; and a computer attached to said frame and in communication with said motorized spindle for controlling said motorized spindle, with said motorized traverse system for controlling said motorized traverse system, and with said motorized roller system for controlling said motorized roller system.

* * * * *